US012146504B2

(12) United States Patent
Hiradate et al.

(10) Patent No.: US 12,146,504 B2
(45) Date of Patent: Nov. 19, 2024

(54) CENTRIFUGAL COMPRESSOR

(71) Applicant: Hitachi Industrial Products, Ltd., Tokyo (JP)

(72) Inventors: Kiyotaka Hiradate, Tokyo (JP); Kazuhiro Tsukamoto, Tokyo (JP); Yuta Mochizuki, Tokyo (JP); Hiromi Kobayashi, Tokyo (JP); Takahiro Nishioka, Tokyo (JP)

(73) Assignee: HITACHI INDUSTRIAL PRODUCTS, LTD., Tokyo (JP)

( * ) Notice: Subject to any disclaimer, the term of this patent is extended or adjusted under 35 U.S.C. 154(b) by 0 days.

(21) Appl. No.: 18/027,977

(22) PCT Filed: Apr. 28, 2021

(86) PCT No.: PCT/JP2021/016943
§ 371 (c)(1),
(2) Date: Mar. 23, 2023

(87) PCT Pub. No.: WO2022/064751
PCT Pub. Date: Mar. 31, 2022

(65) Prior Publication Data

US 2023/0375005 A1 Nov. 23, 2023

(30) Foreign Application Priority Data

Sep. 23, 2020 (JP) ..... 2020-158175
Jan. 28, 2021 (JP) ..... 2021-012085

(51) Int. Cl.
*F04D 29/44* (2006.01)
*F04D 17/12* (2006.01)

(52) U.S. Cl.
CPC ..... *F04D 29/444* (2013.01); *F04D 17/122* (2013.01)

(58) Field of Classification Search
CPC ..... F04D 17/122; F04D 29/444; F04D 29/448
See application file for complete search history.

(56) References Cited

U.S. PATENT DOCUMENTS 5,417,547 A * 5/1995 Harada ..... F04D 29/448 415/208.4
10,760,587 B2 * 9/2020 Larosiliere ..... F04D 29/284
(Continued)

FOREIGN PATENT DOCUMENTS

CN 204061332 U 12/2014
CN 110107539 A 8/2019
(Continued)

OTHER PUBLICATIONS

Machine translation of WO 2015/072231 A1, retrieved from Espacenet on Nov. 18, 2023 (Year: 2023).*
(Continued)

*Primary Examiner* — Courtney D Heinle
*Assistant Examiner* — Sang K Kim
(74) *Attorney, Agent, or Firm* — MATTINGLY & MALUR, PC

(57) ABSTRACT

A centrifugal compressor including: a diffuser in which a fluid flows in a centrifugal direction away from a rotary shaft; a return flow path which is provided downstream of the diffuser and in which fluid flowing in to a later-stage centrifugal impeller from the diffuser flows in a return direction back to the rotary shaft; a plurality of return vanes that are disposed in the shape of a circular vane centered on a centerline of the rotary shaft, and are installed in the return flow path; and a turning part, wherein an inlet blade angle (β) of an outlet guide vane provided to the downstream side, of the return vanes, is lying down more in the circumferen-
(Continued)

tial direction with respect to an inlet blade angle ($\alpha$) of a inlet guide vane provided to the upstream side, of the return vanes ($\beta<\alpha$).

7 Claims, 7 Drawing Sheets

(56) References Cited

U.S. PATENT DOCUMENTS

| | | | | |
|---|---|---|---|---|
| 10,989,202 | B2 * | 4/2021 | Petry | F04D 29/4213 |
| 11,306,734 | B2 * | 4/2022 | Koga | F04D 29/682 |
| 2018/0023586 | A1 * | 1/2018 | Scotti Del Greco | F04D 29/444 416/1 |
| 2022/0025205 | A1 | 1/2022 | Hidalgo et al. | |
| 2023/0219394 | A1 * | 7/2023 | Ailloud | F04D 17/165 454/140 |

FOREIGN PATENT DOCUMENTS

| | | | | |
|---|---|---|---|---|
| JP | 63-046568 | U | 3/1988 | |
| JP | 2001-200797 | A | 7/2001 | |
| JP | 6097487 | B2 | 3/2017 | |
| JP | 6339794 | B2 | 6/2018 | |
| WO | WO-2015072231 | A1 * | 5/2015 | F04D 1/06 |
| WO | 2016/120316 | A1 | 8/2016 | |
| WO | 2018/166716 | A1 | 9/2018 | |

OTHER PUBLICATIONS

International Search Report of PCT/JP2021/016943 dated Jun. 15, 2021.

Extended European Search Report received in corresponding European Application No. 21871886.4 dated Sep. 2, 2024.

* cited by examiner $\alpha^\circ > \beta^\circ$ $\gamma^\circ > \theta^\circ$

CENTRIFUGAL COMPRESSOR

TECHNICAL FIELD OF THE INVENTION

The present invention relates to centrifugal compressors, in particular, to centrifugal compressors suitably including the return vane in the return flow path that constitutes the static flow path.

BACKGROUND ART

Centrifugal fluid machines having rotating centrifugal impellers are conventionally used in various plants, air-conditioning devices, liquid pumps, and the like.

In response to a recent demand for an environmental load reduction, these fluid machines are called for to have higher efficiency and wider operating range than ever before, while the centrifugal compressors themselves are called for to be smaller in order to reduce cost and space in the plant.

In order to achieve high efficiency, a wide operating range, and the miniaturization of fluid machines, it is important to reduce the outer diameter of a static flow path. The static flow path in a centrifugal compressor is a flow path provided on the downstream side of the discharge port of a rotating impeller and formed of a diffuser flow path and a return flow path. In the diffuser flow path and the return flow path, the return flow path is a flow path that removes the swirl component of a flow through the diffuser flow path and directs the flow without pre-swirl to the subsequent stage of the impeller.

However, when the outer diameter of the static flow path is reduced, the length of the return flow path, which constitutes the static flow path, also becomes shorter, and thus it is necessary to turn the flow over a shorter distance to remove the pre-swirl. In order to efficiently turn the flow in the return flow path, which constitutes the static flow path, the return flow path is usually provided with vanes called return vanes at equal intervals in the circumferential direction.

The vanes called return vanes, which are provided in the return flow path at equal intervals in the circumferential direction, are proposed as described in Documents 1 to 3.

In Document 1 described above, in order to obtain a centrifugal turbomachine having a return vane of a shape capable of the degradation of efficiency when the size of the centrifugal turbomachine is reduced, return vanes are arranged in multiple circular vane rows with the center line as the center line, in a return flow path in which a fluid flows in a return direction toward a rotary shaft as the axial direction of the rotary shaft is the height direction. The vane surfaces of the return vanes are curved surfaces that turn the flow of the fluid in the return flow path from a circumferential direction where the center line is the center to a radial direction toward the rotary shaft. In the return vanes, the camber line of a cross-section of an outer vane disposed on the most upstream side crossed in a plane vertical to the axial direction of the rotary shaft shows a curved shape different in the height direction.

Moreover, in order to obtain a centrifugal pump that suppresses a remaining swirling flow when a fluid is led to the subsequent stage of impellers while removing the swirling component of a fluid flow by return vanes, Document 2 described above describes a centrifugal pump including: a rotary shaft that rotates about an axis; a plurality of impellers provided on the rotary shaft in an array in the axial direction, the plurality of impellers being configured to pressure-pump the fluid by centrifugal force; a flow path that inverts the pressure-pumped fluid on the outer side of the radial direction by the upstream impeller on the inner side of the radial direction and that flows the fluid into the impeller on the downstream side; and a plurality of return vanes provided, spaced in the flow path after the fluid is inverted in the circumferential direction, the return vanes being curved such that the fluid is turned toward the inner side of the radial direction. The centrifugal pump has a first communicating unit that communicates a pressure surface with a suction surface such that the return vane inclines to the downstream side from the pressure surface to the suction surface of the return vane.

Furthermore, in order to obtain a multi-stage centrifugal compressor capable of reducing the occurrence of flow separation from the surface of guide vanes without increasing costs, Document 3 described above describes a multi-stage centrifugal compressor having impellers provided in multiple stages; a diffuser provided on the downstream side of the impellers; and a return flow path provided on the downstream side of the diffuser, the diffuser guiding a flow to the impeller in the subsequent stage. The multi-stage centrifugal compressor has: a first circular vane row provided on the outer circumferential side part of the return flow path, the first circular vane row being formed of a plurality of first guide blades that turns the direction of the flow flowing from the diffuser by a first angle; and a second circular vane row provided on an inner circumferential side from the first circular vane row, the second circular vane row being formed of a plurality of second guide blades that turns the direction of the flow flowing from the first circular vane row by a second angle. The first circular vane row and the second circular vane row are staggered.

DOCUMENT LIST

Patent Document

Document 1: Japanese Patent No. 06339794
Document 2: Japanese Patent No. 06097487
Document 3: JP 2001-200797 A

SUMMARY OF INVENTION

Technical Problem

In the case in which the length of the return vane in the radial direction is reduced for a further reduction in the size of the centrifugal compressor, the turning amount of a flow requested between the outlet and the inlet between the return vane becomes relatively larger to the length of the vane.

The return vane of the centrifugal compressor and the centrifugal pump described in Documents 1 to 3 described above has to increase the warpage of a camber line (a line connecting points at an equal distance from the top surface and the under surface of the vane) of a cross-section (a vane shape) of a vane cut in a plane vertical to the axial direction of the principal axis (rotary shaft) with a reduction in the size of the centrifugal compressor and the centrifugal pump, which is highly likely to cause flow separation.

In order to avoid the above-described flow separation, in Documents 1 to 3 described above, a double vane row is provided. In the case in which a further reduction in the size of the centrifugal compressor is considered, a load acting on the individual vanes becomes excessive only considering a simple vane shape. Therefore, even though double or triple vanes are simply provided, a flow is likely separated from the vane surface, which is unlikely to improve efficiency.

The present invention has been made in view of the point described above. An object of the invention is to provide a centrifugal compressor that maintains and improves efficiency while reducing the outer diameter of a static flow path.

Solution to Problem

A centrifugal compressor of the present invention comprises: a rotary shaft; a plurality of centrifugal impellers mounted on the rotary shaft; a diffuser in which a fluid flowing from the centrifugal impeller flows in a centrifugal direction away from the rotary shaft; a return flow path provided on a downstream of the diffuser, wherein the fluid flowing from the diffuser to a subsequent centrifugal impeller flows in the return flow path in a return direction toward the rotary shaft; a plurality of return vanes arranged in a circular vane row shape around a center line of the rotary shaft as a center, the return vanes being installed in the return flow path; and a turning part at which a flow of the fluid flowing out of the diffuser turns from the centrifugal direction to an axial direction and turns from the axial direction to the return direction, wherein the return vanes where a plurality of circular vane rows are provided are disposed in two lines from an upstream side to a downstream side of a flow of the fluid in the return flow path; and wherein an inlet blade angle ($\beta$) of an outlet guide vane provided on the downstream side in the return vanes further inclines in a circumferential direction to an inlet blade angle ($\alpha$) of an inlet guide vane provided on the upstream side in the return vanes ($\beta<\alpha$).

Advantageous Effects of Invention

According to the present invention, it is possible to provide a centrifugal compressor that maintains and improves efficiency while reducing the outer diameter of a static flow path.

DESCRIPTION OF EMBODIMENTS

Figure 1:
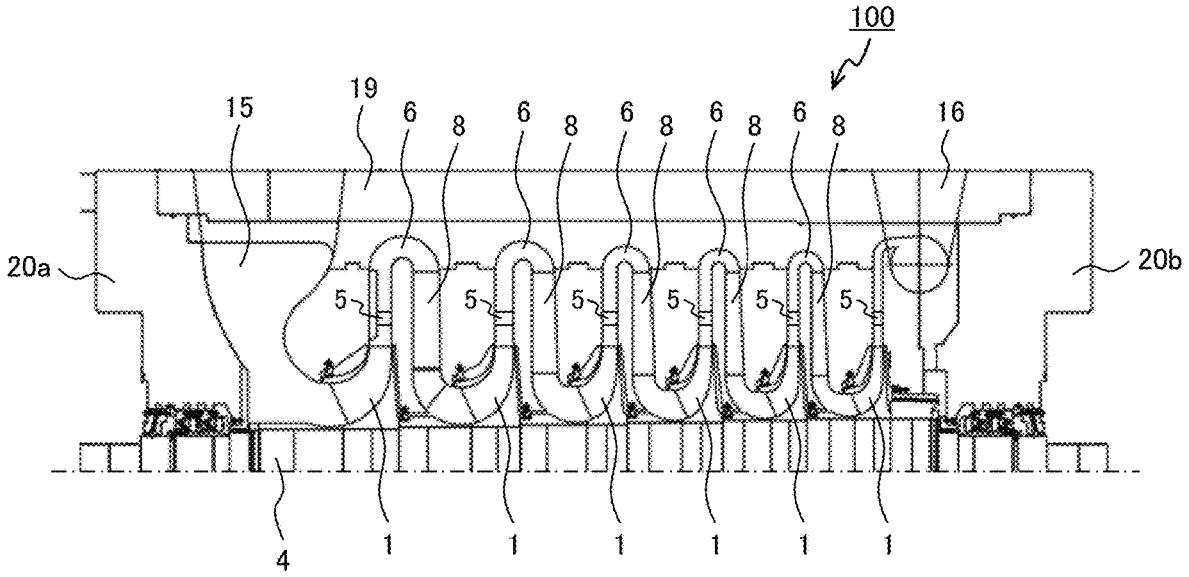
FIG. 1 is a meridional cross-sectional view showing the upper half of the overall structure of a typical centrifugal compressor.

In the following, a centrifugal compressor according to the present invention will be described with reference to embodiments shown in the drawings. Note that in the drawings, the same components are designated with the same reference characters.

First Embodiment

Prior to the description of the first embodiment of a centrifugal compressor according to the present invention, a typical centrifugal compressor will be described with reference to FIGS. 1 to 3.

Figure 2:
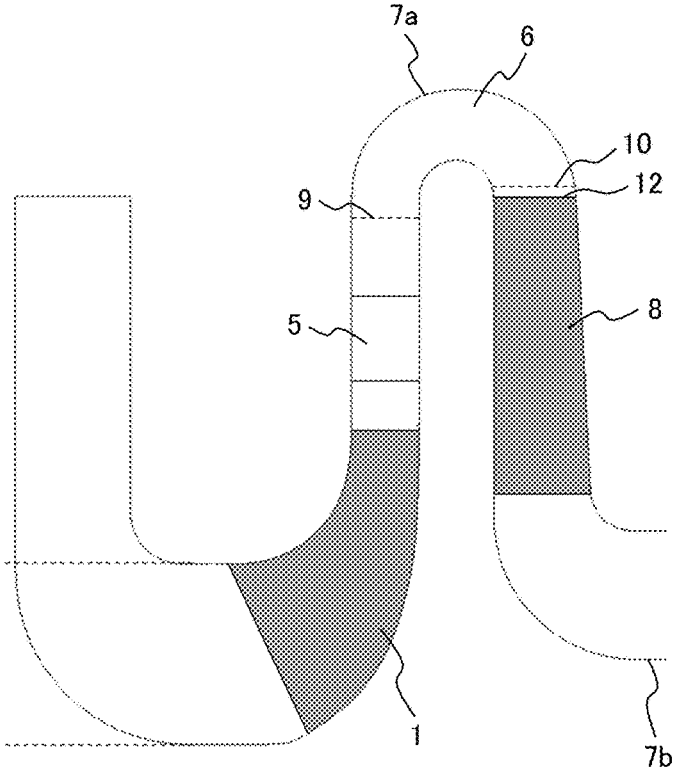
FIG. 2 is a partially enlarged cross-sectional view of the centrifugal compressor shown in FIG. 1.
Figure 3:
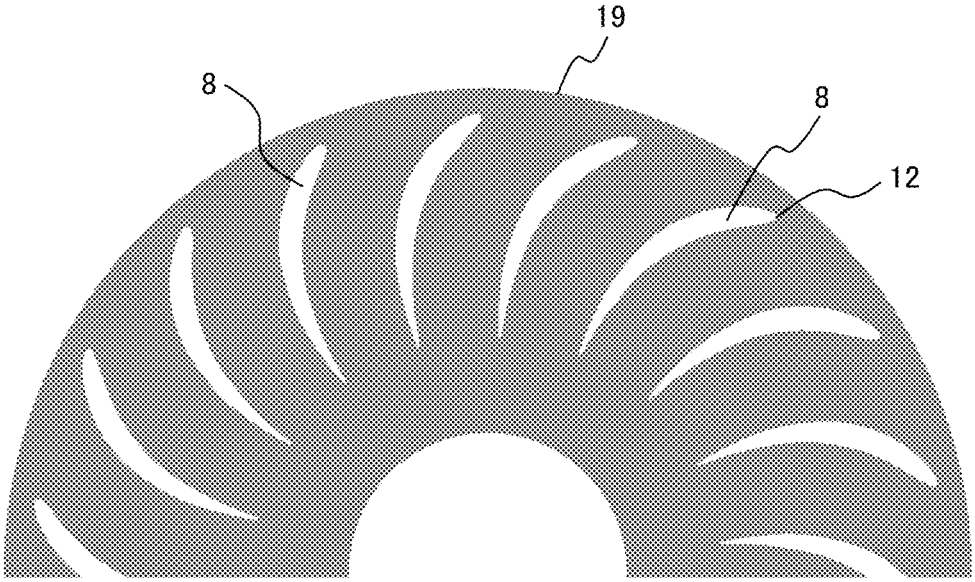
FIG. 3 is a diagram showing half of a state in which a region around return vanes shown in FIGS. 1 and 2 is viewed from the downstream side in the axial direction of a rotary shaft.

As shown in FIGS. 1 to 3, a centrifugal compressor 100 is generally includes a centrifugal impeller 1 that gives rotational energy to the fluid, a rotary shaft 4 on which the centrifugal impeller 1 is mounted, and a diffuser 5 that is located on the outer side of the centrifugal impeller 1 in the radial direction and that converts the dynamic pressure of the fluid flowing out of the centrifugal impeller 1 into static pressure. Furthermore, a return flow path 6 that guides the fluid to a subsequent centrifugal impeller 1 is provided on the downstream of the diffuser 5.

Although not specifically shown in the drawings, the centrifugal impeller 1 generally has a disk (hub) joined to the rotary shaft 4, a side plate (shroud) disposed opposite to the hub, and a plurality of vanes located between the hub and the shroud and disposed spaced in the circumferential direction (in the right angle direction to the sheet surface of FIG. 2).

The diffuser 5 is provided with any one of a vane diffuser having a plurality of vanes disposed at a nearly equal pitch in the circumferential direction and a vaneless diffuser with no vane, not shown in FIG. 2.

Moreover, the return flow path 6 is constituted of turning parts 7*a* and 7*b* at which the flow of the fluid flowing out of the diffuser 5 turns from the centrifugal direction to the axial direction and further turns from the axial direction to the return direction and constituted of a return vane 8 (see FIG. 2). The return flow path 6 has a function that turns the fluid passing the diffuser 5 by the return vane 8 from a radially outward direction to a radially inward direction, and moreover, removes the swirling component of the fluid by the return vane 8 and flows the fluid into the subsequent centrifugal impeller 1 while rectifying the fluid.

As shown in FIG. 2, the turning parts 7*a* and 7*b* that turn from the axial direction to the return direction are formed in a U-shaped bend flow path surrounded by surrounding structures in a meridional plane. The turning part inlet 9 of each of the turning parts 7*a* and 7*b* is defined by a nearly-cylindrical surface corresponding to the outlet of the diffuser 5, and the turning part outlet 10 is defined as a section from the turning part inlet 9 defined by the nearly-cylindrical surface corresponding to the terminal end of the meridional bend flow path located at the direct upstream of a return vane leading edge 12 to the turning part outlet 10.

The return vane 8 is constituted of a plurality of vanes disposed around the rotary shaft 4 at a nearly equal pitch in the circumferential direction. Furthermore, although not specifically shown in the drawings, the centrifugal compressor 100 includes a radial bearing that rotatably supports the rotary shaft 4 on both sides of the rotary shaft 4.

Moreover, plural centrifugal impellers 1 (six centrifugal impellers in FIG. 1) are mounted on the rotary shaft 4 for multi-stage compressing, and the diffuser 5 and the return flow path 6 are provided on the downstream side of the centrifugal impellers 1, as shown in FIG. 2.

The centrifugal impeller 1, the diffuser 5, and the return flow path 6 are housed in a casing 19. The casing 19 is supported by flanges 20*a* and 20*b*. Furthermore, a suction flow path 15 is provided on the suction side of the casing 19, and a discharge flow path 16 is provided on the discharge side of the casing 19.

As shown in FIG. 1, in the centrifugal compressor 100 thus formed, the pressure of a fluid sucked from the suction flow path is raised every time when the fluid passes the centrifugal impeller 1, the diffuser 5, and the return flow path 6 in each stage, and finally when the pressure of the fluid reaches a predetermined pressure, the fluid is discharged from the discharge flow path 16.

In the centrifugal compressor 100 thus formed, if the length of the return vane 8 in the radial direction is reduced for a further size reduction as described above, the turning amount of the flow required between the outlet and the inlet of the return vane 8 becomes relatively large to the length of the centrifugal impeller 1. This might cause flow separation, which is likely to constrict an improvement of the efficiency.

The centrifugal compressor 100 of the present embodiment solves the problem. In the following, the detail of the centrifugal compressor 100 will be described with reference to FIGS. 4 and 5.

Figure 4:
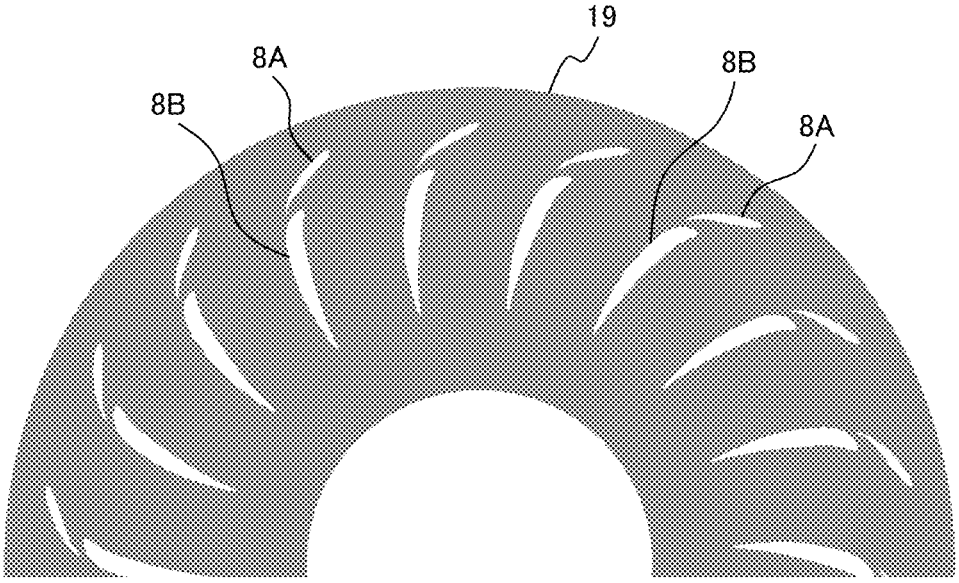
FIG. 4 is a diagram showing half of a state in which a region around return vanes is viewed from the downstream side in the axial direction of a rotary shaft in a centrifugal compressor according to the first embodiment of the present invention.
Figure 5:
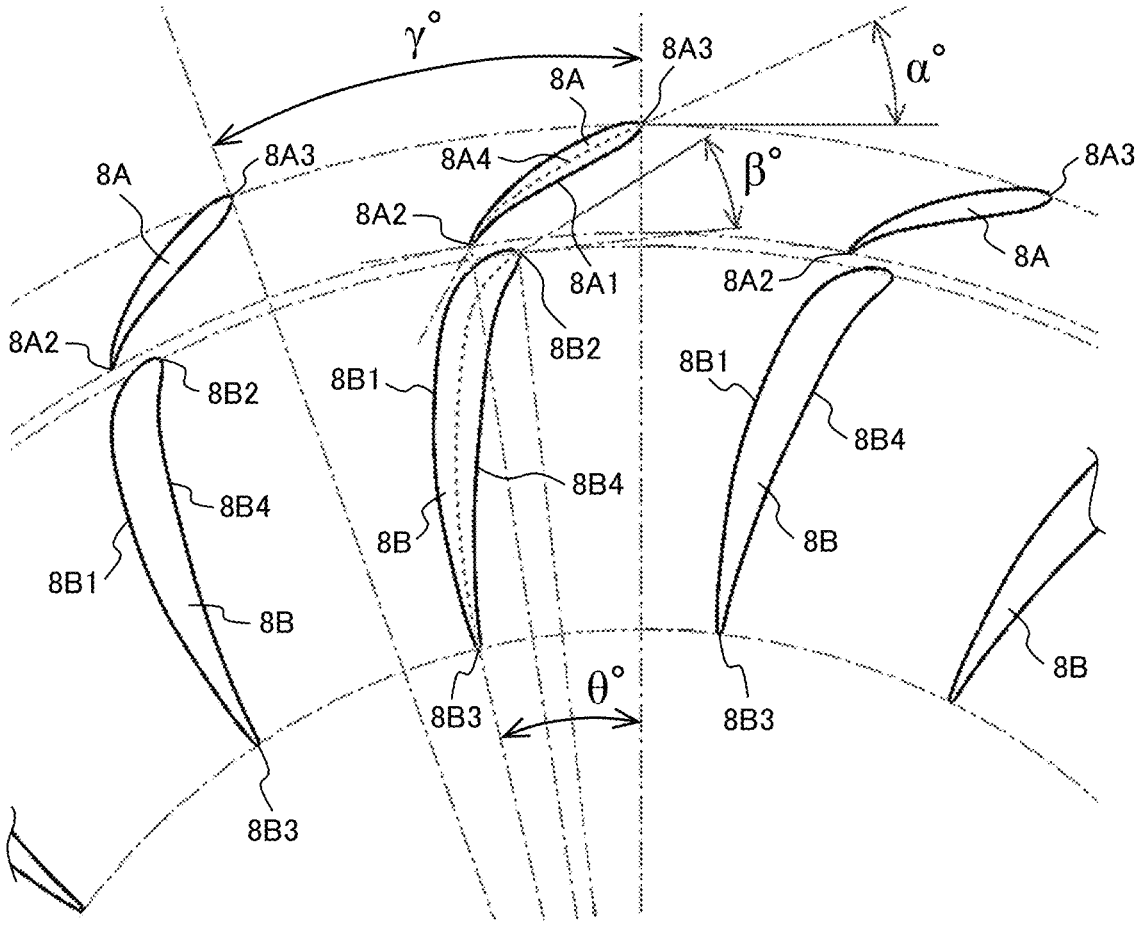
FIG. 5 is a schematic diagram showing the positional relationship between the inlet guide vane and the outlet guide vane of the return vanes in a centrifugal compressor according to the first embodiment of the present invention.

FIG. 4 is a diagram showing half of a state in which a region around the return vane 8 is viewed from the downstream side in the axial direction of the rotary shaft 4 in the first embodiment of the centrifugal compressor 100 according to the present invention. FIG. 5 is a schematic diagram showing the positional relationship between the inlet guide vane 8A and the outlet guide vane 8B of the return vane 8 in the first embodiment of the centrifugal compressor 100 according to the present invention.

The centrifugal compressor 100 of the present embodiment shown in FIGS. 4 and 5 is a centrifugal compressor in which the return vanes 8 having multiple circular vane rows are disposed in two lines from the upstream side to the downstream side of the flow of the fluid in the return flow path 6. In the present embodiment, an inlet blade angle ($\beta$) of the outlet guide vane 8B provided on the downstream side in the return vane 8 further inclines in the circumferential direction to the inlet blade angle ($\alpha$) of the inlet guide vane 8A provided on the upstream side in the return vane 8. More specifically, the relationship between the inlet blade angle ($\beta$) of the outlet guide vane 8B and the inlet blade angle ($\alpha$) of the inlet guide vane 8A of the return vane 8 is $\beta<\alpha$.

Figure 6:
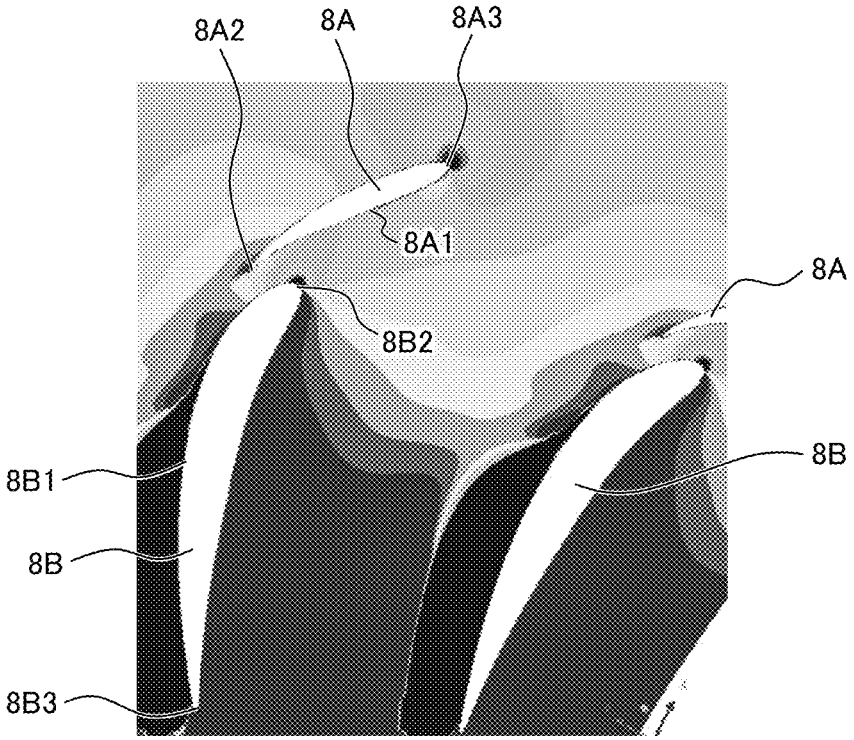
FIG. 6 is a diagram showing the comparison of the angular distributions of flows around the return vanes in a centrifugal compressor according to the first embodiment of the present invention.

As shown in FIG. 6, the distribution of the flow angle around the return vane 8 obtained by numerical analysis shows that the flow angle around the inlet guide vane 8A of the return vane 8 hardly changes from a leading edge 8A3 of the inlet guide vane 8A to a vicinity of a leading edge 8B2 of the outlet guide vane 8B on a pressure surface 8A1 side of the inlet guide vane 8A. This means that the flow only partially turns because the inlet guide vane 8A of the return vane 8 does not form a throat by the vane.

This indicates that the blade angle of the leading edge 8B2 of the outlet guide vane 8B of the return vane 8 has to be at least as large as the blade angle of the inlet guide vane 8A of the return vane 8.

Figure 7:
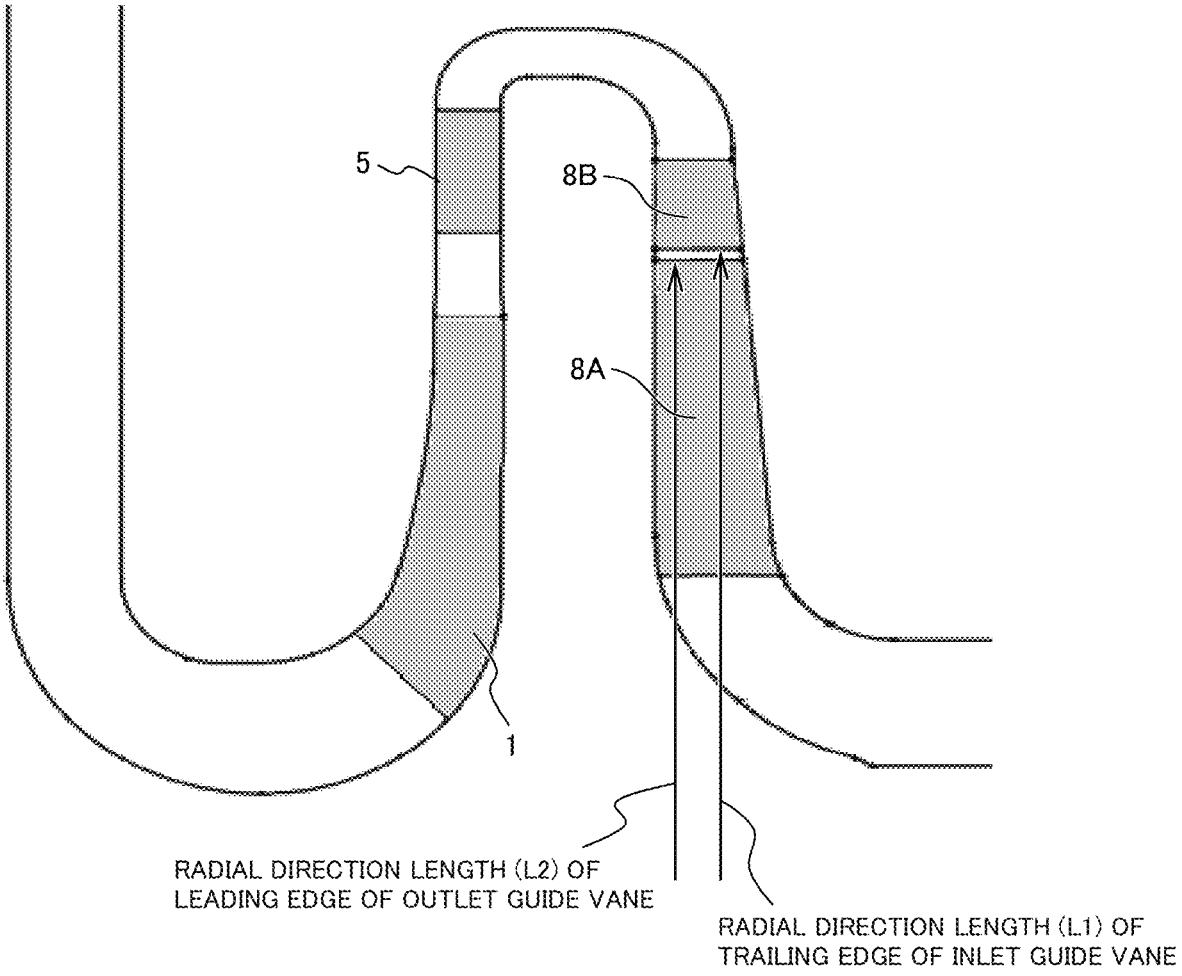
FIG. 7 is a diagram showing the relationship between the length of the trailing edge of the inlet guide vane in the radial direction and the length of the leading edge of the outlet guide vane in the radial direction of the return vanes in a centrifugal compressor according to the first embodiment of the present invention.

Moreover, in the present embodiment, a plurality of the vane-shape return vanes 8 are installed as the inlet guide vane row on the upstream side and the outlet guide vane row on the downstream side in the return flow path 6 in the circumferential direction. In order to guide the flow of the pressure surface side 8A1 of the inlet guide vane 8A to a suction surface 8B1 of the outlet guide vane 8B of the return vane 8, the outlet guide vane 8B of the return vane 8 is provided offset to the pressure surface 8A1 side of the inlet guide vane 8A. As shown in FIG. 7, the leading edge 8B2 of the outlet guide vane 8B of the return vane 8 is provided such that the length of in the radial direction from the center of the rotary shaft 4 is short to the trailing edge 8A2 of the inlet guide vane 8A (a relationship L1>L2 is satisfied shown in FIG. 7).

Moreover, an angle ($\theta$) formed by the leading edge 8A3 of the inlet guide vane 8A of the return vane 8 and the trailing edge 8B3 of the outlet guide vane 8B is smaller than an angle ($\gamma$) formed by the leading edge 8A3 of the inlet guide vane 8A of the return vane 8 and the leading edge 8A3 of another inlet guide vane 8A adjacent to the inlet guide vane 8A in the circumferential direction.

Furthermore, in the present embodiment, a camber line 8A4 of the inlet guide vane 8A of the return vane 8 (a line connecting points at an equal distance from the top surface and the under surface of the vane) has a constant blade angle in 50% or more of the front half portion from the leading edge 8A3 to the trailing edge 8A2 of the inlet guide vane 8A.

Figure 8:
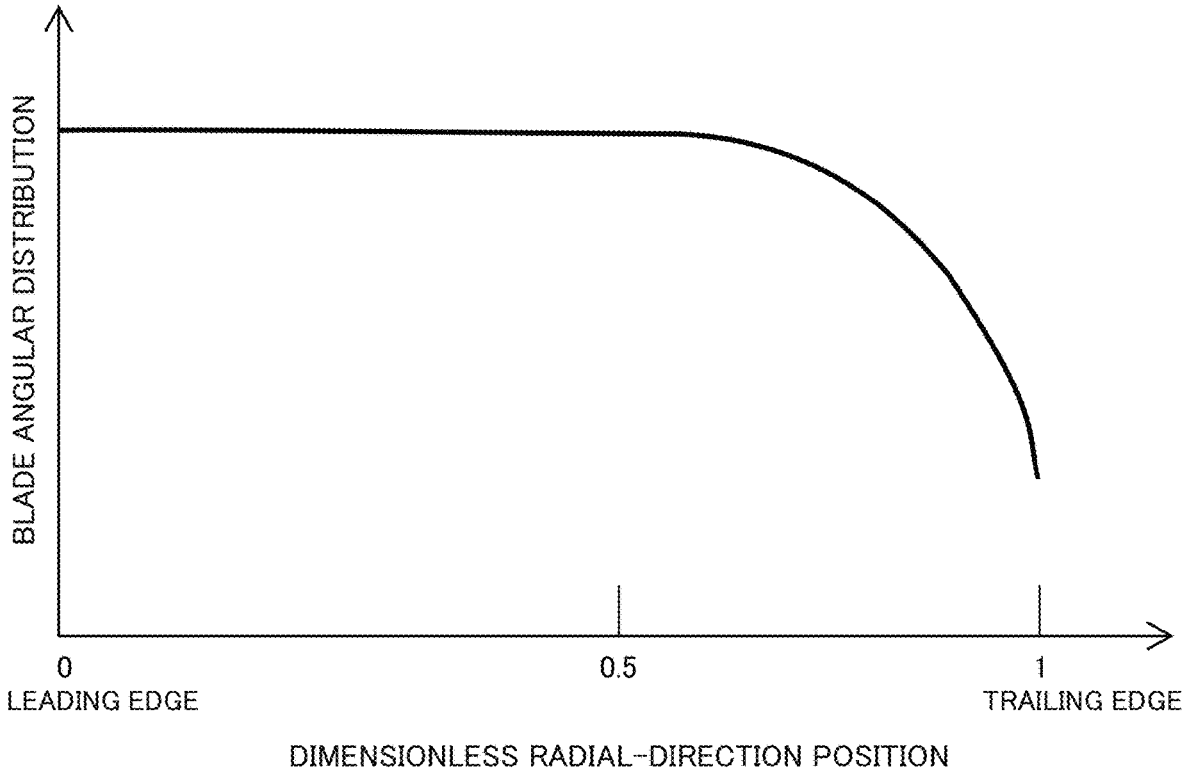
FIG. 8 is a diagram showing the relationship between the dimensionless radial-direction position of the inlet guide vane (the horizontal axis) and the blade angular distribution (the vertical axis) of the return vanes in a centrifugal compressor according to the first embodiment of the present invention.

This means that the angle of the camber line 8A4 of the inlet guide vane 8A of the return vane 8 shown in FIG. 5 does not change in a half or more (50% or more) of the leading edge 8A3 side from the leading edge 8A3 to the trailing edge 8A2 of the inlet guide vane 8A of the return vane 8. The relationship between the dimensionless radial-direction position (the horizontal axis) and the blade angular distribution (the vertical axis) in the inlet guide vane 8A of the return vane 8 shown in FIG. 8 indicates that the angle of the camber line 8A4 of the inlet guide vane 8A of the return vane 8 does not change in a half or more (50% or more) of the leading edge 8A3 side from the leading edge 8A3 to the trailing edge 8A2 of the inlet guide vane 8A of the return vane 8.

The centrifugal compressor 100 of the present embodiment thus formed has an effect as follows.

The inlet blade angle ($\beta$) more inclines in the circumferential direction to the inlet blade angle ($\alpha$) of the inlet guide vane 8A provided on the upstream side in the return vane 8. More specifically, the inlet blade angle ($\beta$) of the outlet guide vane 8B and the inlet blade angle ($\alpha$) of the inlet guide vane 8A of the return vane 8 are set to have the relationship $\beta<\alpha$. This causes the fluid to flow from the suction surface 8B1 of the outlet guide vane 8B.

Thus, a pressure in the flow path formed between the vanes of the inlet guide vane 8A and the outlet guide vane 8B of the return vane 8 is raised to increase the flow rate of the flow passing the flow path. When the flow rate is increased, the momentum of the flow passing the suction surface 8B1 of the outlet guide vane 8B increases, and then it is possible to suppress flow separation occurring on the suction surface 8B1 of the outlet guide vane 8B. By suppressing flow separation, it is possible to achieve both the suppression of degradation of efficiency caused by separation and the turning of the flow.

In addition, since the pressure of a pressure surface 8B4 of the outlet guide vane 8B is relatively decreased by causing the flow to collide against the suction surface 8B1 of the outlet guide vane 8B of the return vane 8 side, a pressure difference between the pressure surface 8B4 of the outlet guide vane 8B and the suction surface 8B1 of another outlet guide vane 8B adjacent to the outlet guide vane 8B becomes small.

This suppresses the secondary flow generated between the pressure surface 8B4 of the trailing edge 8B of the return vane 8 and the suction surface 8B1 of the adjacent trailing edge 8B. This suppression of the secondary flow makes it possible to suppress the loss of a flow field due to the secondary flow.

Furthermore, by making the camber line 8A4 of the inlet guide vane 8A of the return vane 8 a constant vane angle for 50% or more of the front half portion from the leading edge 8A3 to the trailing edge 8A2 of the inlet guide vane 8A, it is possible to keep the chord length longer.

This causes suppression of separation on the vane suction surface due to the vane load reduction in the inlet guide vane 8A of the return vane 8 and the elongation of the distance from the leading edge 8A3 of the inlet guide vane 8A to the leading edge 8B2 of the outlet guide vane 8B, and then a flow-direction pressure gradient between adjacent vanes becomes gentle. Thus, it is possible to suppress the separation of a boundary layer, which develops on the side wall in the return flow path 6.

Therefore, according to the centrifugal compressor 100 in the present embodiment, it is possible to maintain and improve the efficiency while reducing the outer diameter of the static flow path. This effect causes reduction of costs and improvement of operational efficiency, and also causes reduction of the exclusive area in the field of the centrifugal compressor 100 by reducing the outer diameter.

Second Embodiment

In the following, the second embodiment of a centrifugal compressor according to the present invention will be described with reference to FIGS. 4, 5, and 9.

A centrifugal compressor 100 of the present embodiment is, like of the first embodiment, a centrifugal compressor in which a return vane 8 having multiple circular vane rows shown in FIGS. 4 and 5 are disposed in two lines from the upstream side to the downstream side of the flow of the fluid in the return flow path 6. In the present embodiment, an inlet blade angle $\beta$ of an outlet guide vane 8B provided on the downstream side in the return vane 8 further inclines in the circumferential direction to the inlet blade angle $\alpha$ of an inlet guide vane 8A provided on the upstream side in the return vane 8. More specifically, the relationship between the inlet blade angle $\beta$ of the outlet guide vane 8B and the inlet blade angle $\alpha$ of the inlet guide vane 8A of the return vane 8 is $\beta<\alpha$.

Subsequently, in the present embodiment, a plurality of the vane-shape return vanes 8 are installed in the return flow path 6 in the circumferential direction as an inlet guide vane row on the upstream side and an outlet guide vane row on the downstream side in the return flow path 6. In order to guide the flow of a pressure surface 8A1 side of the inlet guide vane 8A to a suction surface 8B1 of the outlet guide vane 8B of the return vane 8, the outlet guide vane 8B of the return vane 8 is provided offset on the pressure surface 8A1 side of the inlet guide vane 8A.

Moreover, an angle ($\theta$) formed by a leading edge 8A3 of the inlet guide vane 8A and a trailing edge 8B3 of the outlet guide vane 8B of the return vane 8 is smaller than an angle ($\gamma$) formed by the leading edge 8A3 of the inlet guide vane 8A of the return vane 8 and the leading edge 8A3 of another inlet guide vane 8A adjacent to the inlet guide vane 8A in the circumferential direction.

Furthermore, in the present embodiment, the maximum camber position of the inlet guide vane 8A is set at the latter half of the chord. The feature of the shape of the inlet guide vane 8A of the return vane 8 in the centrifugal compressor 100 according to the present embodiment will be described with reference to FIG. 9.

Figure 9:
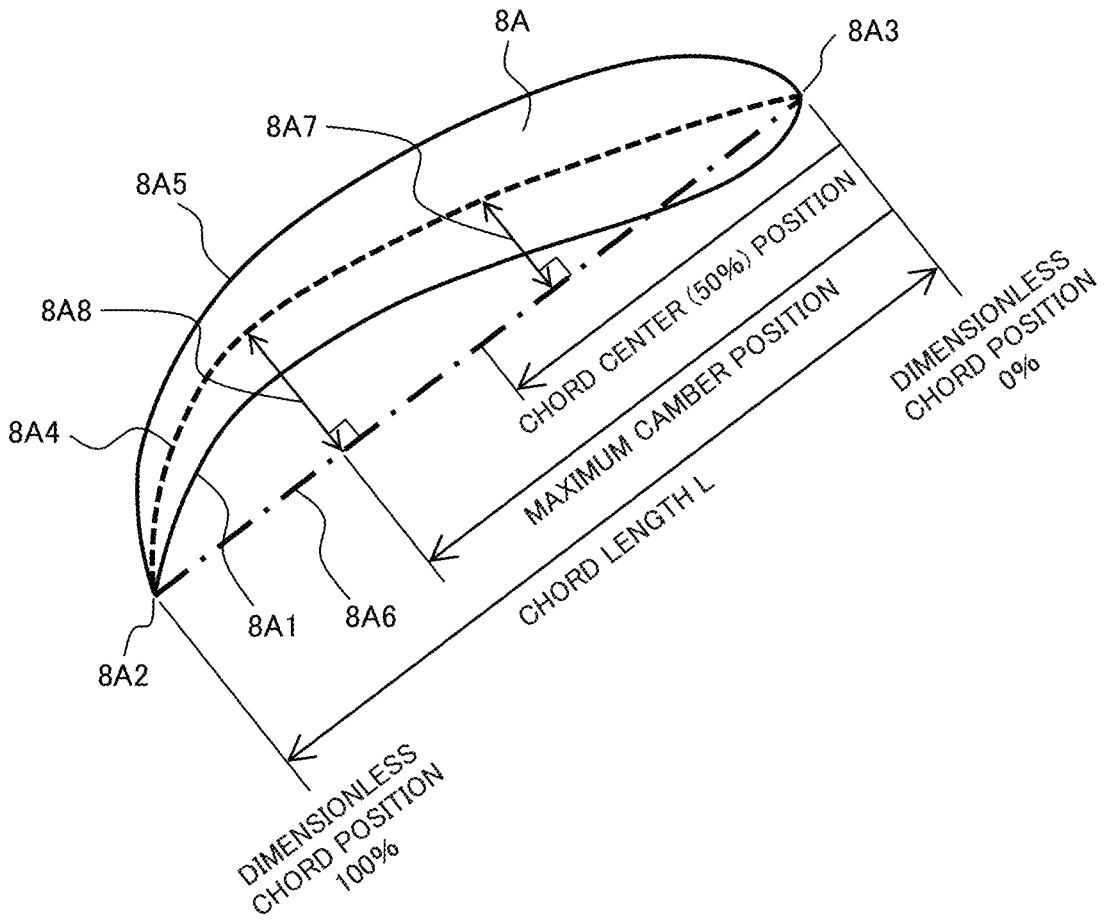
FIG. 9 is a diagram showing the feature of the shape of the inlet guide vane of a return vane in a centrifugal compressor according to the second embodiment of the present invention.

FIG. 9 is a diagram showing the feature of the shape of the inlet guide vane 8A of the return vane 8 in the second embodiment of the centrifugal compressor 100 according to the present invention.

Note that a dash-dot line 8A6 shown in FIG. 9 indicates a chord line that is a straight line connecting the leading edge 8A3 to a trailing edge 8A2 of the inlet guide vane 8A. A dotted line 8A4 shown in FIG. 9 indicates the camber line of the inlet guide vane 8A. Furthermore, an arrow 8A7 shown in FIG. 9 indicates the camber of the inlet guide vane 8A. The camber is a distance for a perpendicular line extending in the vertical direction from a given position of the chord line 8A6 to reach the camber line 8A4. Further, an arrow 8A8 shown in FIG. 9 indicates the maximum camber at which the camber of the inlet guide vane 8A is maximum.

On the chord line 8A6 in FIG. 9, the distance from the leading edge 8A3 to the maximum camber 8A8 of the inlet guide vane 8A is referred to as the maximum camber position. The maximum camber position is expressed by a ratio (dimensionless cord position) to the length of the chord line 8A6 (the chord length L). Here, the leading edge 8A3 of the inlet guide vane 8A corresponds to a position at which the dimensionless cord position is 0%, and the trailing edge 8A2 corresponds to a position at which the dimensionless cord position is 100%.

In the present embodiment, the maximum camber position of the inlet guide vane 8A is set on the trailing edge 8A2 side from the chord center (the position at which the dimensionless cord position is 50%), i.e., on the latter half of the chord.

The effect of the centrifugal compressor 100 of the present embodiment thus formed is the same as the effect of the first embodiment. In addition, since the maximum camber position of the inlet guide vane 8A is set in the latter half of the chord, the following effect is further obtained.

That is, as shown in FIG. 9, since the shape of the camber line 8A4 of the inlet guide vane 8A abruptly bends near the trailing edge 8A2, the direction of the flow along the pressure surface 8A1 of the inlet guide vane 8A is a direction toward the suction surface 8B1 of the outlet guide vane 8B shown in FIG. 5.

This flow holds a flow flowing along the suction surface 8B1 of the outlet guide vane 8B on the vane surface, suppressing the flow separation occurring on the suction surface 8B1 of the outlet guide vane 8B. By suppressing the flow separation occurring on the suction surface 8B1 of the outlet guide vane 8B, it is possible to achieve both the suppression of degradation of efficiency caused by separation and the turning of the flow.

When the shape of the camber line 8A4 of the inlet guide vane 8A abruptly bends, the flow is prone to separate near the bend on a suction surface 8A5 of the inlet guide vane 8A. However, in the present embodiment, the separation region of the suction surface 8A5 is restricted to the region near the trailing edge 8A2 since the abrupt bend of the camber line 8A4 of the inlet guide vane 8A is restricted to the vicinity of the trailing edge 8A2.

As a result, it is possible to effectively suppress the flow separation at the suction surface 8B1 of the trailing edge 8B while minimizing an increase of the pressure loss in the leading edge 8A.

In addition, in the present embodiment, it is preferable, as shown in FIG. 7, that the leading edge 8B2 of the outlet guide vane 8B of the return vane 8 is provided such that the length in the radial direction from the center of the rotary shaft 4 is short to the trailing edge 8A2 of the inlet guide vane 8A a relationship L1>L2 is satisfied shown in FIG. 7), like the first embodiment.

This is due to the following reasons. In order to suppress flow separation occurring on the suction surface 8B1 of the outlet guide vane 8B, it is most effective to narrow the flow path width formed between vanes in the latter half of the pressure surface 8A1 of the inlet guide vane 8A and the front half of the suction surface 8B1 of the outlet guide vane 8B as much as possible and to direct the flow from the pressure surface 8A1 of the inlet guide vane 8A to the vicinity of the front half of the vane where a reduction in the flow rate becomes largest on the vane surface to easily cause separation on the suction surface 8B1.

On the other hand, when the flow path width formed between vanes in the latter half of the pressure surface 8A1 of this inlet guide vane 8A and the front half of the suction surface 8B1 of the outlet guide vane 8B is too narrowed, processability is degraded because a working tool in a small diameter has to be used for cutting when cutting this region. Therefore, in order to secure the flow path width formed between vanes in the latter half of the pressure surface 8A1 of the inlet guide vane 8A and the front half of the suction surface 8B1 of the outlet guide vane 8B to the extent that processability is not degraded, it is necessary to reduce the angle (θ) formed by the leading edge 8A3 of the inlet guide vane 8A and the trailing edge 8B3 of the outlet guide vane 8B of the return vane 8 to increase the offset amount to the pressure surface 8A1 side of the inlet guide vane 8A of the outlet guide vane 8B, or it is necessary to shorten the length in the radial direction from the center of the rotary shaft 4 at the leading edge 8B2 of the outlet guide vane 8B to the trailing edge 8A2 of the inlet guide vane 8A to provide a gap in the radial direction.

As in the present embodiment, when the shape of the camber line 8A4 of the inlet guide vane 8A abruptly bends near the trailing edge 8A2, if the flow path width formed between vanes in the latter half of the pressure surface 8A1 of the inlet guide vane 8A and the front half of the suction surface 8B1 of the outlet guide vane 8B is secured only by reducing the angle (θ) formed by the leading edge 8A3 of the inlet guide vane 8A and the trailing edge 8B3 of the outlet guide vane 8B of the return vane 8, it is inevitable to increase the reduction amount of the angle (θ) formed by the leading edge 8A3 of the inlet guide vane 8A and the trailing edge 8B3 of the outlet guide vane 8B of the return vane 8.

In this case, the position to which the flow from the pressure surface 8A1 of the inlet guide vane 8A goes moves to the downstream side from the vicinity of the front half where a reduction in the flow rate becomes largest on the vane surface to easily cause separation on the suction surface 8B1 of the outlet guide vane 8B, reducing the effect of suppressing flow separation on the suction surface 8B1.

In order to avoid this problem and to secure the flow path width formed between vanes in the latter half of the pressure surface 8A1 of the inlet guide vane 8A and the front half of the suction surface 8B1 of the outlet guide vane 8B such that processability is not degraded, it is recommended that the length in the radial direction from the center of the rotary shaft 4 to the leading edge 8B2 of the outlet guide vane 8B for the leading edge 8B2 of the outlet guide vane 8B is shorter than the length for the trailing edge 8A2 of the inlet guide vane 8A. That is, it is recommended to adopt a scheme to provide a gap in the radial direction between the leading edge 8B2 of the outlet guide vane 8B and the trailing edge 8A2 of the inlet guide vane 8A.

According to the centrifugal compressor 100 of the present embodiment, it is possible to maintain and improve efficiency while reducing the outer diameter of the static flow path, and therefore it is possible to reduce costs and improve operational efficiency. It is also possible to reduce the exclusive area in the field of the centrifugal compressor 100 by reducing the outer diameter.

In addition, the present invention is not limited to the foregoing embodiments, and includes various exemplary modifications. For example, the foregoing embodiments are described in detail for easy understanding of the present invention, and are not necessarily limited to ones including all the described configurations. Furthermore, a part of the configuration of an embodiment is replaceable with the configuration of another embodiment, and the addition of the configuration of another embodiment to the configuration of an embodiment is also possible. Furthermore, in regard to a part of the configurations of the embodiments, another configuration may be added, removed, and replaced.

LIST OF REFERENCE CHARACTERS

1 . . . centrifugal impeller
4 . . . rotary shaft
5 . . . diffuser
6 . . . return flow path
7*a*, 7*b* . . . turning part
8 . . . return vane
8A . . . inlet guide vane of return vane
8A1 . . . pressure surface of inlet guide vane of return vane
8A2 . . . trailing edge of inlet guide vane of return vane
8A3 . . . leading edge of inlet guide vane of return vane
8A4 . . . camber line of inlet guide vane of return vane
8A5 . . . suction surface of inlet guide vane of return vane
8A6 . . . chord line of inlet guide vane of return vane
8A7 . . . camber of inlet guide vane of return vane
8A8 . . . maximum camber of inlet guide vane of return vane
8B . . . outlet guide vane of return vane
8B1 . . . suction surface of outlet guide vane of return vane
8B2 . . . leading edge of outlet guide vane of return vane
8B3 . . . trailing edge of outlet guide vane of return vane
8B4 . . . pressure surface of outlet guide vane of return vane
9 . . . turning part inlet
10 . . . turning part outlet
12 . . . return vane leading edge
15 . . . suction flow path
16 . . . discharge flow path
19 . . . casing
20*a*, 20*b* . . . flange
100 . . . centrifugal compressor
L . . . chord length
α . . . inlet blade angle of inlet guide vane of return vane
β . . . inlet blade angle of outlet guide vane of return vane
θ . . . angle formed by leading edge of inlet guide vane of return vane and trailing edge of outlet guide vane γ . . . angle formed by leading edge of inlet guide vane of return vane and leading edge of adjacent inlet guide vane in circumferential direction

What is claimed is:

1. A centrifugal compressor comprising:

a rotary shaft;

a plurality of centrifugal impellers mounted on the rotary shaft;

a diffuser in which a fluid flowing from the centrifugal impeller flows in a centrifugal direction away from the rotary shaft;

a return flow path provided on a downstream of the diffuser, wherein the fluid flowing from the diffuser to a subsequent centrifugal impeller flows in the return flow path in a return direction toward the rotary shaft;

a plurality of return vanes arranged in a circular vane row shape around a center line of the rotary shaft as a center, the return vanes being installed in the return flow path such that a turning part outlet is located at a direct upstream of a leading edge; and a turning part at which a flow of the fluid flowing out of the diffuser turns from the centrifugal direction to an axial direction and turns from the axial direction to the return direction, wherein the return vanes where a plurality of circular vane rows are provided are disposed in two lines from an upstream side to a downstream side of a flow of the fluid in the return flow path; and wherein an inlet blade angle (β) of an outlet guide vane provided on the downstream side in the return vanes and an inlet blade angle (α) of an inlet guide vane provided on the upstream side in the return vanes have a relationship $\beta<\alpha$, wherein a maximum camber position of a camber line of the inlet guide vane is located in a latter half of a chord line, wherein the maximum camber position is a position in the chord line at which a distance is maximum, the distance being a distance of a perpendicular line extending in a vertical direction from a given position in the chord line connecting a leading edge and a trailing edge of the inlet guide vane to reach the camber line.

2. The centrifugal compressor according to claim 1, wherein, in the return flow path, the return vanes in a vane shape are installed as an inlet guide vane row on the upstream side and as an outlet guide vane row on the downstream side in the return flow path in a circumferential direction; and wherein, in order to guide a flow on a pressure surface side of the inlet guide vane to a suction surface of the outlet guide vane, the outlet guide vane is provided offset to the pressure surface side of the inlet guide vane, and wherein a radial distance from a center of the rotary shaft to the leading edge of the outlet guide vane is shorter than the radial distance from the center of the rotary shaft to a trailing edge of the inlet guide vane.

3. The centrifugal compressor according to claim 2, wherein an angle (θ) is defined by a first line and a second line wherein the first line is an imaginary line extending from the center of the shaft to the leading edge of the inlet guide vane and the second line is an imaginary line extending from the center of the shaft to the trailing edge of the outlet guide vane and formed by a is smaller than an angle (γ) which is defined by the first line and a third line wherein the first line is the imaginary line extending from the center of the shaft to the leading edge of the inlet guide vane and the third line is an imaginary line extending from the center of the shaft to the leading edge of adjacent inlet guide vane.

4. The centrifugal compressor according to claim 3, wherein the camber line of the inlet guide vane has a constant blade angle in 50% or more of a front half portion from the leading edge to the trailing edge of the inlet guide vane, the camber line being a line connecting points at an equal distance from a top surface and an under surface of the vane and the constant blade angle being defined by the front half portion of the camber line and the first line which is the imaginary line extending from the center of the shaft to the leading edge of the inlet guide vane.

5. The centrifugal compressor according to claim 1, wherein, in the return flow path, the return vanes in a vane shape is installed as an inlet guide vane row on an upstream side and as an outlet guide vane row on the downstream side in the return flow path in a circumferential direction; and wherein, in order to guide a flow on a pressure surface side of the inlet guide vane to a suction surface of the outlet guide vane, the outlet guide vane is provided offset to the pressure surface side of the inlet guide vane.

6. The centrifugal compressor according to claim 5, wherein an angle (θ) formed by a leading edge of the inlet guide vane and a trailing edge of the outlet guide vane is smaller than an angle (γ) formed by the leading edge of the inlet guide vane and a leading edge of another inlet guide vane adjacent to the inlet guide vane in a circumferential direction.

7. The centrifugal compressor according to claim 1, wherein a radial distance from a center of the rotary shaft to the leading edge of the outlet guide vane is shorter than the radial distance from the center of the rotary shaft to a trailing edge of the inlet guide vane.

* * * * *